US010816249B2

(12) United States Patent
Goel

(10) Patent No.: US 10,816,249 B2
(45) Date of Patent: Oct. 27, 2020

(54) COMPRESSOR PROTECTION AND CONTROL IN HVAC SYSTEMS

(71) Applicant: Lennox Industries Inc., Richardson, TX (US)

(72) Inventor: Rakesh Goel, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 943 days.

(21) Appl. No.: 14/706,535

(22) Filed: May 7, 2015

(65) Prior Publication Data

US 2016/0327323 A1 Nov. 10, 2016

(51) Int. Cl.
*F25B 49/02* (2006.01)
*F25B 39/02* (2006.01)

(52) U.S. Cl.
CPC ..... *F25B 49/022* (2013.01); *F25B 39/028* (2013.01); *F25B 2400/075* (2013.01); *F25B 2700/21155* (2013.01); *F25B 2700/21174* (2013.01)

(58) Field of Classification Search
CPC ..... F24F 11/0076; F24F 11/001; F24F 2011/0052; F25B 31/00; F24D 27/0269; F24D 27/0276; F24D 27/0284; F24D 27/0292
See application file for complete search history.

(56) References Cited

U.S. PATENT DOCUMENTS 4,934,155 A * 6/1990 Lowes ..... F25B 40/00 62/197
7,412,842 B2 * 8/2008 Pham ..... F04C 28/00 62/228.5
8,590,325 B2 * 11/2013 Pham ..... F25B 49/022 62/129
8,763,424 B1 * 7/2014 Albertson ..... F25B 39/028 62/498
2008/0209925 A1 * 9/2008 Pham ..... F25B 49/022 62/126

(Continued)

OTHER PUBLICATIONS

U.S. Appl. No. 14/954,531, Goel et al.
U.S. Appl. No. 14/954,558, filed Goel et al.

*Primary Examiner* — Jianying C Atkisson
*Assistant Examiner* — Meraj A Shaikh
(74) *Attorney, Agent, or Firm* — Shackelford, Bowen, McKinley & Norton, LLP

(57) ABSTRACT

Provided are a method and apparatus for controlling the operation of a compressor of an HVAC system in response to the refrigerant super heat value for refrigerant within the compressor. First and second signals are received for indicating one or more temperature values of refrigerant substantially at the first compressor sump and within the first distributor tube, respectively. A saturated suction temperature is estimated using at least the second signal. A first super heat value is calculated for refrigerant substantially at the first compressor sump using at least the saturated suction temperature and the one or more temperature values indicated by the first signal. A first control signal is generated for at least de-energizing the first compressor if the calculated first super heat value is below a tolerance value defining the minimum super heat value at which the first compressor may be operated.

19 Claims, 3 Drawing Sheets

(56) References Cited

U.S. PATENT DOCUMENTS

| | | | | |
|---|---|---|---|---|
| 2009/0090117 | A1* | 4/2009 | McSweeney | F25B 49/005 62/204 |
| 2009/0090118 | A1* | 4/2009 | Pham | F04B 39/06 62/228.5 |
| 2009/0095002 | A1* | 4/2009 | McSweeney | F25B 49/022 62/216 |
| 2011/0070100 | A1* | 3/2011 | McSweeney | F04B 35/04 417/53 |
| 2011/0132019 | A1* | 6/2011 | Hamada | F25B 30/02 62/324.1 |
| 2011/0185753 | A1* | 8/2011 | Lifson | F25B 31/006 62/115 |
| 2011/0264409 | A1* | 10/2011 | Jayanth | F04B 35/04 702/182 |
| 2016/0018148 | A1* | 1/2016 | Yura | F25B 13/00 62/192 |

* cited by examiner

COMPRESSOR PROTECTION AND CONTROL IN HVAC SYSTEMS

BACKGROUND

Field of the Invention

This application is directed, in general, to heating, ventilation, and air conditioning systems (HVAC) and, more specifically, to systems and methods for protection and control of compressors, including protection and control of compressors configured for tandem operation.

Description of the Related Art

Long term compressor reliability is a critical concern in HVAC systems. Compressor reliability is improved through implementation of control methods designed to protect the compressor of an HVAC system. The operating life of a compressor may be greatly improved through implementation of protection and control logic that avoids operation of the compressors during unsafe conditions.

Compressor protection and control may be more difficult in certain types of HVAC systems. For example, some HVAC systems utilize one or more compressors configured for operation as tandem compressors. Advantageously, tandem compressors may allow for more efficient HVAC system operation over a broad demand range. A tandem compressor HVAC system may, for example, efficiently meet a partial load demand by operating only one compressor from among the tandem compressor group to meet the partial load demand. The tandem compressor HVAC system may also provide for a greater full load capacity, as the multiple compressors within the tandem compressor group may be simultaneously operated to meet large demands on the HVAC system. Importantly, tandem compressors may share common refrigerant piping. Specifically, the suction pipe leg for each tandem compressor may diverge from a single, common suction pipe. Similarly, the discharge pipe leg for each tandem compressor may converge into a single, common discharge pipe.

A common means for monitoring operation and performance of a compressor as part of a protection and control method may utilize sensed pressures of refrigerant entering into, and discharged from, the compressor. This means of separately monitoring the operation of a single compressor may be useful in HVAC systems implemented with a single compressor. Refrigerant pressure monitoring may not be effective, however, for separately monitoring the operation of a single compressor within a tandem compressor group. Since the tandem compressors may share common piping, separately sensing the refrigerant pressures corresponding to a particular compressor of a tandem compressor group may not be possible. The refrigerant pressures corresponding to each compressor of a tandem compressor group may equalize through the common piping accessing each tandem compressor.

Another means for monitoring operation and performance of a compressor as part of a compressor protection and control method may utilize sensed temperatures of refrigerant within, and discharged from, the compressor. The refrigerant temperature values may be indicative of the performance of the specific compressor to which they correspond. Refrigerant temperature monitoring may be an effective means of separately monitoring the operation and performance of a compressor, whether the compressor is configured as a single compressor within the HVAC system or is part of a tandem compressor group. Importantly, regarding tandem compressors, the refrigerant temperatures corresponding to a particular compressor within a tandem compressor group may be separately sensed at the compressor sump and discharge port. The temperature of refrigerant within, and at the discharge port of, a particular compressor of a tandem compressor group may not equalize through the common piping shared by each compressor of the tandem compressor group. Refrigerant temperature monitoring may, therefore, be particularly useful for compressor monitoring, protection, and control and may be implemented within HVAC systems having a single compressor or tandem compressors.

In either single or tandem compressor systems, important refrigerant temperature conditions indicating operation and performance conditions within a particular compressor are the saturation temperature of refrigerant within the HVAC system and the temperature of refrigerant at the compressor sump. Commonly, the saturation temperature of refrigerant within the HVAC system is determined by correlating a sensed refrigerant pressure value, which may be sensed using one or more pressure transducers, to a corresponding saturation temperature of the refrigerant.

SUMMARY

In accordance with the present invention, systems and methods for protecting and controlling the operation of a compressor are provided. A first system may comprise a first compressor which may comprise a first sump and may be in fluid communication with a common suction pipe. The first system may comprise a first sensor which may couple to the first compressor. The first sensor may transmit a first signal to a location remote to the first sensor. The first signal may indicate at least one temperature value of refrigerant substantially at the first sump. The first system may comprise an evaporator which may couple to a first distributor tube at an inlet of the evaporator. The evaporator may be in fluid communication with the common suction pipe at an outlet of the evaporator. The first system may comprise a second sensor which may couple to the first distributor tube. The second sensor may transmit a second signal to a location remote to the second sensor. The second signal may indicate at least one temperature value of refrigerant within the first distributor tube. The first system may comprise a controller which may be operable to receive the second signal. The controller may determine an estimated saturated suction temperature based at least in part upon the at least one temperature value indicated by the second signal. The controller may be further operable to receive the first signal and determine a first super heat value based at least in part upon the estimated saturated suction temperature and the at least one temperature value of refrigerant substantially at the first sump indicated by the first signal. The controller may be further operable to generate a first control signal configured to switch the first compressor to a de-energized state from an energized state if the first super heat value is less than a first tolerance value.

A second system may comprise a first compressor which may comprise a first sump and may be in fluid communication with a common suction pipe. The second system may comprise a first thermistor which may couple to the first compressor. The first thermistor may transmit a first signal to a location remote to the first thermistor, indicating at least one temperature value of refrigerant substantially at the first sump. The second system may comprise an evaporator which may couple to a first distributor tube at an inlet of the evaporator. The evaporator may be in fluid communication with the common suction pipe at an outlet of the evaporator. The second system may comprise a second sensor which may couple to the first distributor tube. The second sensor may transmit a second signal to a location remote to the second sensor, indicating at least one temperature value of refrigerant within the first distributor tube. The second system may comprise a second compressor which may comprise a second sump and may be in fluid communication with a common suction pipe. A second thermistor may couple to the second compressor. The second thermistor may transmit a third signal to a location remote to the second thermistor, indicating at least one temperature value of refrigerant substantially at the second sump. The second system may comprise a controller which may be operable to receive the second signal. The controller may determine an estimated saturated suction temperature based at least in part upon the at least one temperature value indicated by the second signal. The controller may be further operable to receive the first signal and determine a first super heat value. The first super heat value may be the difference between the at least one temperature value of refrigerant substantially at the first sump indicated by the first signal and the estimated saturated suction temperature. The controller may be further operable to receive the third signal and determine a second super heat value. The second super heat value may be the difference between the at least one temperature value of refrigerant substantially at the second sump indicated by the third signal and the estimated saturated suction temperature. The controller may be further operable to generate a first control signal configured to switch the first compressor to a de-energized state from an energized state if the first super heat value is less than a first tolerance value. The controller may be further operable to generate a second control signal configured to switch the second compressor to a de-energized state from an energized state if the second super heat value is less than a second tolerance value.

A first method for controlling a compressor of an HVAC system is provided. A first sensor may couple to a first compressor. The first compressor may comprise a first sump and may be in fluid communication with a common suction pipe. The first sensor may transmit a first signal to a location remote to the first sensor indicating at least one temperature value of refrigerant substantially at the first sump. A second sensor may couple to a first distributor tube. The second sensor may transmit a second signal to a location remote to the second sensor indicating at least one temperature value of refrigerant within the first distributor tube. The first distributor tube may couple to an inlet of an evaporator. The evaporator may be operatively coupled to be in fluid communication with the common suction pipe at an outlet of the evaporator. A controller may be operable to receive the second signal from the second sensor. The controller may determine an estimated saturated suction temperature based on at least the at least one temperature value indicated by the second signal. The controller may be operable to receive the first signal from the first sensor. The controller may determine a first super heat value based at least in part upon at least the estimated saturated suction temperature and the at least one temperature value indicated by the first signal. The controller may be operable to generate a first control signal configured to switch the first compressor from an energized to a de-energized state if the first super heat value is below a first tolerance value.

Advantageously, the apparatus and method provided may provide a cost-effective means for ascertaining the saturation temperature of refrigerant within an HVAC system as well as for ascertaining the super heat temperature value for refrigerant within a compressor. The super heat temperature value may be used for separately monitoring a particular compressor for use in protecting and controlling the compressor. Advantageously, the apparatus and method provided, herein, may be implemented in an HVAC system provided with a single compressor or in an HVAC system provided with tandem compressors. The refrigerant super heat temperature values derived using the apparatus and method provided, herein, may be utilized as part protection and control methods for ensuring that a compressor, whether a single compressor or a tandem compressor, is not operated in unsafe conditions. The apparatus and method provided, herein, may prolong the working life of a compressor of an HVAC system.

BRIEF DESCRIPTION OF THE DRAWINGS

For a more complete understanding of the present invention and the advantages thereof, reference is now made to the following Detailed Description taken in conjunction with the accompanying drawings, in which.

DETAILED DESCRIPTION

Figure 1:
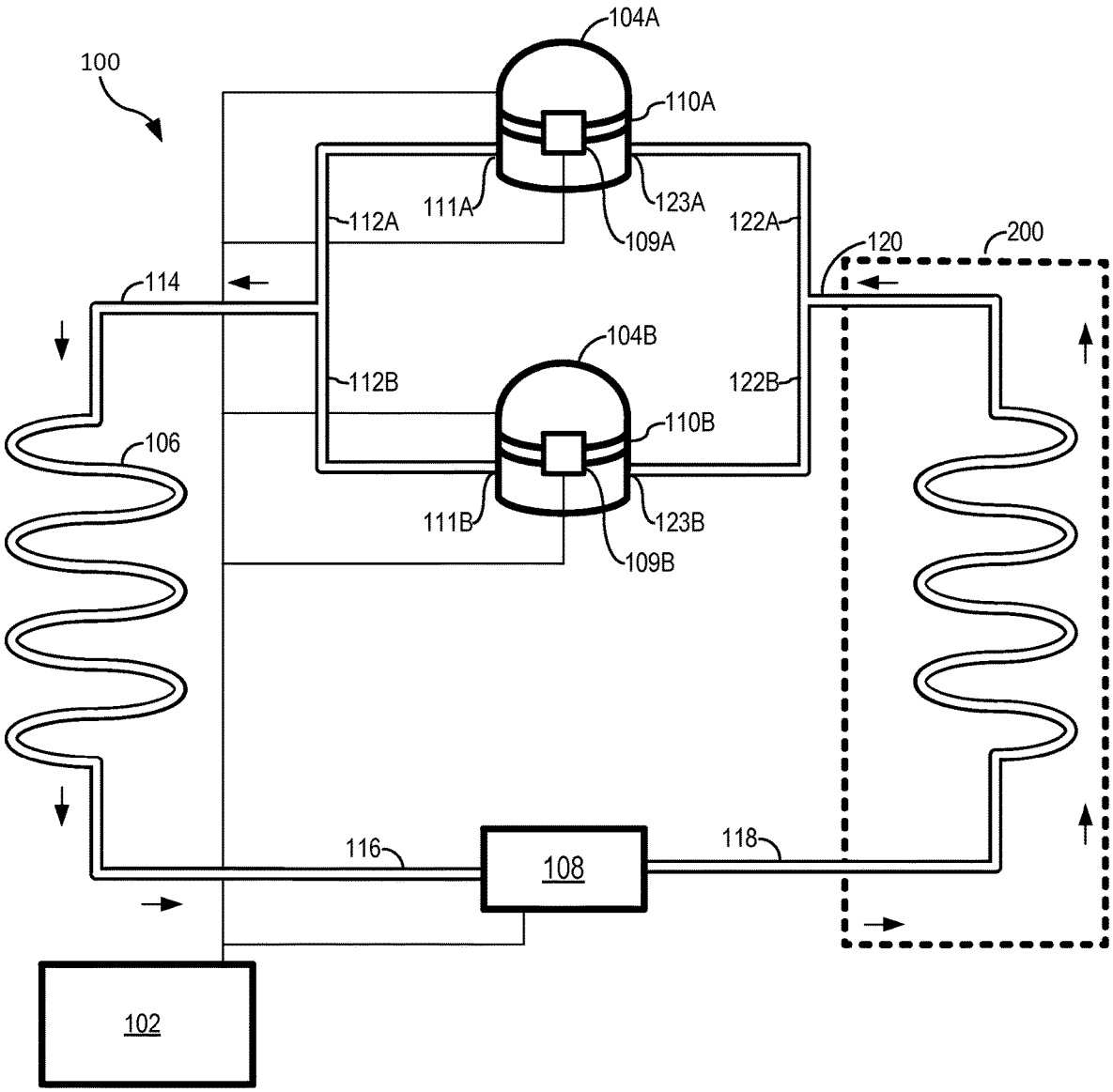
FIG. 1 illustrates a block diagram of an HVAC system 100.

Referring to FIG. 1, an HVAC system 100 for providing conditioned supply air to a space is shown. According to the embodiment shown, the HVAC system 100 may include a controller 102, a compressor 104A, a compressor 104B, a condenser 106, a metering device 108, a sump sensor 109A, a sump sensor 109B, a crank case heater 110A, a crank case heater 110B, an evaporator section 200, and the refrigerant piping arrangement shown. In alternative embodiments, the HVAC system 100 may be provided with additional or fewer components than those shown in the embodiment of FIG. 1. For example, in an alternative embodiment, the HVAC system 100 may include: additional, or fewer, compressors 104; additional, or fewer, condensers 106 and/or evaporator sections 200, such as in a Variable Refrigerant Flow (VRF) system; additional metering devices 108; and/or additional or fewer sump sensors 109, and the like. According to the embodiment of FIG. 1, the HVAC system 100 may be a tandem compressor system, having two or more compressors incorporated within a single loop of components configured for vapor compression cycle operation. It will be appreciated by those of ordinary skill in the art that the compressor protection and control apparatus and method described, herein, may be implemented in alternative embodiments of the HVAC system 100 which do not include a tandem compressor group, such as in a HVAC system 100 provided with one compressor, only.

Additionally, or alternatively, the HVAC system 100 may include different components than as shown in the embodiment of FIG. 1. For example, the HVAC system 100 may include one or more valves, such as check valves, reversing valves, three way valves, four way valves, and the like for controlling the direction and/or rate of refrigerant flow within the HVAC system 100. Additionally, or alternatively, the HVAC system 100 may include one or more refrigerant compensators, accumulators, or the like, for removing, or adding, refrigerant to the HVAC system 100 during operation of the HVAC system 100. Those of ordinary skill in the art will appreciate that corresponding changes to the piping arrangement of the HVAC system 100 may be provided to accommodate the features, functions, and components of such alternative embodiments of the HVAC system 100.

As shown in FIG. 1, in an embodiment, the HVAC system 100 may be provided with a piping arrangement that includes a discharge pipe leg 112A, a discharge pipe leg 112B, a common discharge pipe 114, a high pressure liquid pipe 116, a low pressure liquid pipe 118, a common suction pipe 120, a suction pipe leg 122A, and a suction pipe leg 122B. In alternative embodiments, the HVAC system 100 may be provided with a piping arrangement different from that shown in FIG. 1, configured to accommodate the specific features, functions, and components of the particular HVAC system 100 embodiment.

According to the embodiment shown in FIG. 1, the HVAC system 100 piping may direct refrigerant flow in a circuit through the HVAC system 100 components. The compressors 104A, B may each receive low pressure gaseous refrigerant from the evaporator assembly 200 via the common suction pipe 120 and the respective suction legs 122A, B. The compressors 104A, B may compress the received refrigerant and discharge high pressure, high temperature gaseous refrigerant to the condenser 106 via the respective discharge legs 112A, B and via the common discharge pipe 114. High pressure, high temperature liquid refrigerant may exit the condenser 106 and be routed to the metering device 108 via the high pressure liquid pipe 116. Low pressure liquid refrigerant may be routed from the metering device 108 to the evaporator assembly 200 via the low pressure liquid pipe 118, completing the refrigerant flow circuit through the HVAC system 100.

The HVAC system 100 may be configured for use with refrigerant as part of vapor compression cycle operation. The HVAC system 100 may provide heating, ventilation, or cooling supply air to a space. The HVAC system 100 may be used in residential or commercial buildings, and in refrigeration. The HVAC system 100 is not necessarily capable of all of heating, ventilation, and air conditioning operations. In an embodiment, the HVAC system 100 may be a heat pump unit, a heating only unit, a cooling only unit, a VRF unit, or the like. Additionally, the HVAC system 100 may be a single stage or multi-stage unit. The HVAC system 100 may be configured to operate in response to both full load and partial load demands. According to the embodiment shown, full load demand may require operation of both compressors 104A and 104B while partial load demand may require operation of only one compressor 104A or 104B.

The HVAC system 100 may comprise a controller 102 for controlling, monitoring, protecting, and/or configuring the HVAC system 100 components and operations. The controller 102 may be implemented with control logic for selectively energizing, or de-energizing, one or more HVAC system 100 components in response to demands on the HVAC system 100, user input, data received from sensors, and the like. The controller 102 may alert users of operational statuses, conditions, and component failures of the HVAC system 100. The controller 102 may be connected to the HVAC system 100 components via wired or wireless connections. The controller 102 may be provided with hardware, software, and/or firmware.

In an embodiment, the controller 102 may be provided with one or more internal components configured to perform one or more of the functions of a memory, a processor, and/or an input/output (I/O) interface. The controller 102 memory may store computer executable instructions, operational parameters for system components, calibration equations, predefined tolerance values, or ranges, for HVAC system 100 operational conditions, and the like. The controller 102 processor may execute instructions stored within the controller 102 memory. The controller 102 I/O interface may operably connect the controller 102 to the HVAC system 100 components such as the compressors 104A, B, the sump sensors 109A, B, the crank case heaters 110A, B, the metering device 108, the distributor sensor 214 (shown in FIG. 2, described below), as well as other components that may be provided.

The controller 102 may be provided with logic for monitoring and/or reconfiguring operation of the HVAC system 100 components as part of one or more protection and/or control methods. In an embodiment, the controller 102 may receive data from one or more remote devices, such as sensors, configured to sense refrigerant temperatures or pressures at one or more locations within the HVAC system 100. The controller 102 may use the sensed data, as received, or, alternatively, may calibrate the sensed data received. For example, the controller 102 may perform "corrective" adjustments to the received data through application of one or more calibration equations which may be stored within the controller 102 memory.

The data received by the controller 102 may comprise signals from one or more remote devices. The controller 102 may receive one or more signals directly from one or more remote devices. Alternatively, the controller 102 may receive one or more signals indirectly from one or more remote devices, such as through one or more intermediate devices. The one or more intermediate devices may comprise signal converters, processors, input/output interfaces, amplifiers, conditioning circuits, connectors, and the like.

In an embodiment, the controller 102 may use data received from one or more sensors as part of a calculation, or estimation, of one or more parameter values. The calculated, or estimated, parameter values may be used in further calculations, or estimations, of additional parameter values, or may be compared to one or more tolerance values stored within the controller 102 memory. The controller 102 may reconfigure aspects of the HVAC system 100 operation in response to the outcomes of such comparisons. For example, the controller 102 may take one or more corrective actions in response to determining that a parameter value is out-of-tolerance including, perhaps, de-energizing one or more of the compressors 104A, B.

As shown in FIG. 1, in an embodiment, the HVAC system 100 may include the compressors 104A, B which may compress received refrigerant as part of a vapor compression cycle. The compressors 104A, B may be compressors of any type comprising the prior art, such as reciprocating compressors, scroll compressors, and the like. The compressors 104A, B may be single speed or variable speed compressors. The compressors 104A, B may operatively couple to the controller 102 via wired, or wireless, connections. The controller 102 may selectively energize, and operate, either or both of the compressors 104A, B in response to demands on the HVAC system 100.

As shown in the embodiment of FIG. 1, the compressors 104A, B may be tandem compressors within a tandem compressor group. The compressors 104A, B may both be part of a single circuit of components configured for vapor compression cycle operation. The HVAC system 100 may have a "merged" piping configuration, whereby both of the compressors 104A, B are in fluid communication with common piping sections. The compressors 104A, B may receive refrigerant from the suction pipe legs 122A, B, respectively, which may each comprise a refrigerant piping path diverging from the common suction pipe 120. The suction pipe legs 122A, B may couple to the compressors 104A, B, respectively, at the suction ports 123A, B, respectively. The refrigerant received at each suction port 123A, B may, therefore, be refrigerant at substantially the same temperature and pressure.

The compressors 104A, B may be operated either independently or in concert to meet a demand on the HVAC system 100, as needed. During operation, one or both of the compressors 104A, B may compress the refrigerant and discharge the refrigerant into the discharge pipe legs 112A, B, respectively. The discharge pipe legs 112A, B may couple to the compressors 104A, B, respectively, at the discharge ports 111A, B, respectively. The discharge pipe legs 112A, B may merge to form the common discharge pipe 114 which may route the HVAC system 100 refrigerant to the condenser 106 as part of the vapor compression cycle. During operation, low pressure and low temperature refrigerant may be received by one or both of the compressors 104A, B and may be discharged as high pressure, high temperature refrigerant.

The compressors 104A, B may each comprise a motor (not labeled) and a sump (not labeled) disposed within the compressor 104A, B. The motor may be energized to cause compression of the HVAC system 100 refrigerant within the compressor 104A, B. The sump may be a reservoir within the compressor 104A, B at which a liquid lubricating fluid, such as oil, may collect. The HVAC system 100 refrigerant received by the compressors 104A, B via the respective suction ports 123A, B may collect within the compressors 104A, B in one or more areas that may be open to the respective compressor 104A, B sumps. As such, both refrigerant and liquid lubricating oil may be present, simultaneously, at the respective compressor 104A, B sumps.

Those of ordinary skill in the art will appreciate that mixing of refrigerant with oil within the compressor 104A, B sumps may damage internal features and components of the compressors 104A, B. It may be desirable, therefore, to prevent mixing of the refrigerant and oil within the sump of the compressors 104A, B by maintaining the refrigerant within the sump of each compressor 104A, B in the gaseous state. Further, it may be desirable to avoid operation of the compressors 104A, B at times when liquid phase refrigerant may be present in the compressors 104A, B. Importantly, liquid phase refrigerant may be present within the compressor, or compressors, 104A, B at times when refrigerant within the compressor, or compressors, 104A, B is at, or below, the saturation temperature of the refrigerant, as described below.

Referring to FIG. 1, in an embodiment, the HVAC system 100 may include the sump sensors 109A, B. The sump sensors 109A, B may directly sense, calculate, approximate, or determine from sensed data, the HVAC system 100 refrigerant temperatures. In an embodiment, the temperature data sensed, calculated, approximated, or determined by the respective sump sensors 109A, B may indicate temperatures of the HVAC system 100 refrigerant substantially at the respective compressor 104A, B sumps, as discussed below. The sump sensors 109A, B may be operably connected to the controller 102 via wired or wireless connections and may transmit signals comprising sensed data to the controller 102. In an embodiment, the sump sensors 109A, B may be thermistors. In an alternative embodiment, the sump sensors 109A, B may be thermocouples, resistive temperature devices, infrared sensors, thermometers, or the like.

In an embodiment, the sump sensors 109A, B may transmit analog or pneumatic signals either directly, or indirectly, to the controller 102. In such an embodiment, the signals transmitted by the sump sensors 109A, B may be converted to digital signals prior to use by the controller 102. Alternatively, in an embodiment, the sump sensors 109A, B may transmit digital signals to the controller 102. In such an embodiment, the digital signals transmitted by the sump sensors 109A, B may be processed prior to use by the controller 102 to convert the signals to a different voltage, to remove interference from the circuits, to amplify the signals, or other similar forms of digital signal processing. For each alternative described, herein, the signals of the sump sensors 109A, B may be transmitted to the controller 102 directly or indirectly, such as through one or more intermediary devices.

The sump sensors 109A, B may couple to the compressors 104A, B, respectively. The sump sensors 109A, B may be disposed at locations along the outer surface of the respective compressors 104A, B proximal to the respective compressor 104A, B sumps disposed within to the respective compressors 104A, B. The sump sensors 109A, B may, for example, couple to side surfaces of the compressors 104A, B, respectively, and may be configured to sense temperature data for the HVAC system 100 refrigerant substantially at the respective compressor 104A, B sumps. Alternatively, in an embodiment, the sump sensors 109A, B may couple to bottom surfaces of the compressors 104A, B, respectively. According to such embodiments, the respective sump sensors 109A, B may be disposed proximal to the respective compressor 104A, B sumps. The respective sump sensors 109A, B may be configured to sense temperature data for the HVAC system 100 refrigerant substantially at the respective compressor 104A, B sumps, meaning the temperature data sensed by the respective sump sensors 109A, B may closely approximate, or be equal to, temperature data for the HVAC system 100 refrigerant at the respective compressor 104A, B sumps. In an embodiment, for example, the sump sensors 109A, B may couple to external surfaces of the respective compressors 104A, B and may sense HVAC system 100 refrigerant temperatures, respectively, within 1 degree Fahrenheit of the HVAC system 100 refrigerant at the respective compressor 104A, B sumps. Advantageously, coupling the sump sensors 109A, B to external surfaces of the respective compressors 104A, B may allow for access, maintenance, or replacement of the sump sensors 109A, B without requiring removal or replacement of the respective compressor 104A, B.

In a further alternative embodiment, the sump sensors 109A, B may be internal components of the respective compressors 104A, B. In such an embodiment, the sump sensors 109A, B, or a sensing component thereof, may be disposed at, or proximal to, the respective compressor 104A, B sumps. In such further alternative embodiments, the respective sump sensors 109A, B may sense temperature data for the HVAC system 100 refrigerant located at, or proximal to, the respective compressor 104A, B sumps. Alternatively, the temperature data sensed by the respective sump sensors 109A, B may closely approximate, or be equal to, temperature data for the HVAC system 100 refrigerant at the respective compressor 104A, B sumps. In an embodiment, for example, the sump sensors 109A, B may be disposed within the respective compressors 104A, B and may sense HVAC system 100 refrigerant temperatures, respectively, within 1 degree Fahrenheit of the HVAC system 100 refrigerant at the respective compressor 104A, B sumps.

As shown in FIG. 1, in an embodiment, the HVAC system 100 may include the crank case heaters 110A, B. The crank case heaters 110A, B may couple to the compressors 104A, B, respectively, for heating the HVAC system 100 refrigerant within the compressors 104A, B, as needed. The crank case heaters 110A, B may operably couple to the controller 102 via wired or wireless connections. The crank case heaters 110A, B may be selectively energized by the controller 102 in response to conditions within the HVAC system 100 and may warm the refrigerant within the respective compressors 104A, B when energized.

Each crank case heater 110A, B may comprise a loop of material configured to fit snugly around the outer surface of the compressors 104A, B, respectively, coupling the crank case heaters 110A, B to the compressors 104A, B. The crank case heaters 110A, B may couple to the compressors 104A, B, respectively, along the outer surfaces of the respective compressors 104A, B. The crank case heaters 110A, B may be disposed at locations along the external surfaces of the respective compressors 104A, B proximal to the internal locations of the respective compressor 104A, B sumps. In an embodiment, the sump sensors 109A, B may be coupled to outer surfaces of the respective compressors 104A, B using the respective crank case heaters 110A, B. In such an embodiment, the sump sensors 109A, B may be disposed between the loops of the respective crank case heaters 110A, B and a surface of a compressor 104A, B.

Referring to FIG. 1, the HVAC system 100 may include the condenser 106. The condenser 106 may be a heat exchanger which may allow for heat transfer between the HVAC system 100 refrigerant flowing through the condenser 106 and air passing over the condenser 106. In an embodiment, the condenser 106 may be a fin-and-tube, microchannel, or other similar heat exchanger commonly used in HVAC systems. Refrigerant may condense from high pressure gas to high pressure liquid as the refrigerant passes through the condenser 106, rejecting heat to air passing over the condenser 106. Operation and control of condensers as part of the vapor compression cycle is known to those of ordinary skill in the relevant art and is, thus omitted from this description.

Referring to FIG. 1, the HVAC system 100 may include the metering device 108. High pressure liquid refrigerant may be routed from the condenser 106 via the high pressure liquid pipe 116 to the metering device 108. The metering device 108 may throttle the flow of refrigerant to the evaporator section 200, causing a pressure drop of the liquid refrigerant. In an embodiment, the metering device 108 may be a short orifice, a thermal expansion valve (TXV), an electronic expansion valve (EXV), or the like. The metering device 108 may be operably coupled to the controller 102 via a wired or wireless connection. In an embodiment, the metering device 108 may be configured to operate independent from the controller 102. Operation and control of metering devices is known to those of ordinary skill in the relevant art and is, thus, omitted from this description.

Figure 2:
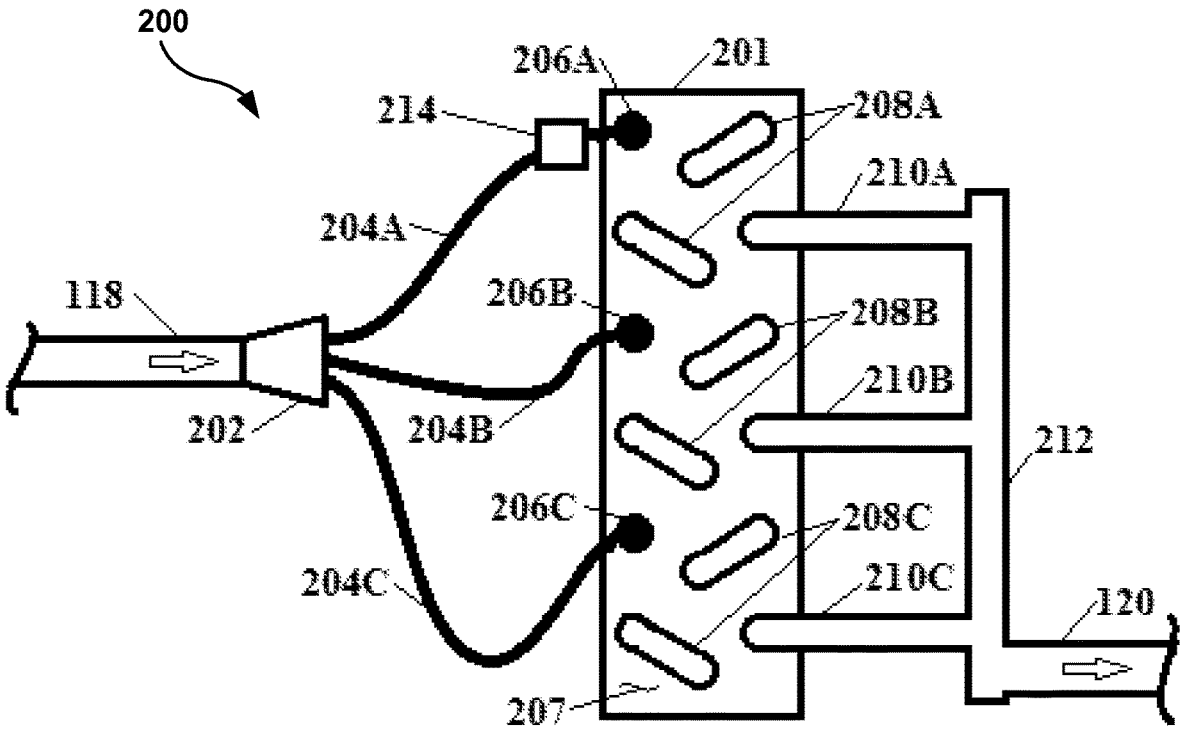
FIG. 2 illustrates a side view of an evaporator section 200 of the HVAC system 100; and, FIG. 3 shows a flowchart of a method 300 for protection and control of a compressor 104 of the HVAC system 100.

Referring to FIG. 2, an evaporator section 200 of the HVAC system 100 is shown. According to the embodiment shown, the evaporator section 200 may include an evaporator coil 201, a distributor nozzle 202, a plurality of distributor tubes 204A-C, a plurality of inlet tubes 206A-C, an end plate 207, a plurality of return pipe legs 208A-C, a plurality of outlet pipe legs 210A-C, a manifold 212, and a distributor sensor 214. In alternative embodiments, the evaporator section 200 may be provided with additional, fewer, or different components than those shown in the embodiment of FIG. 2. The refrigerant piping configuration of the embodiment shown, including the quantity and location of the distributor nozzle 202, the distributor tubes 204, the inlet tubes 206, the return pipe legs 208, the outlet pipe legs 210, and the manifold 212, as well as the circuit arrangement through the evaporator coil 201 are illustrative, only. Those of ordinary skill in the art will appreciate that the evaporator section 200 may be provided with a refrigerant piping configuration differing from that of the embodiment of FIG. 2, as shown, while still being capable of performing the method 300, as described below.

The evaporator section 200 may include the evaporator coil 201 which may be a heat exchanger. The evaporator coil 201 may allow for heat transfer between the HVAC system 100 refrigerant within the evaporator coil 201 and air passing over the evaporator coil 201. In an embodiment, the evaporator coil 201 may be a fin-and-tube, microchannel, or other similar heat exchanger commonly used in HVAC systems.

Low pressure liquid refrigerant may enter the evaporator section 200 via the low pressure liquid pipe 118. The distributor nozzle 202 may couple to the low pressure liquid pipe 118 and may split the refrigerant flow to direct a portion of the HVAC system 100 refrigerant received into each of the distributor tubes 204A-C. The distributor tubes 204A-C may route the refrigerant to the inlet tubes 206A-C, respectively, of the evaporator coil 201. The refrigerant may be routed through several return legs 208A-C as the refrigerant flow makes several passes through the tubes of the evaporator coil 201. As the HVAC system 100 refrigerant flows within the evaporator coil 201, the refrigerant may absorb heat from air passing over the evaporator coil 201 and may change from the liquid state to the gaseous state. Gaseous HVAC system 100 refrigerant may exit the evaporator coil 201 via the outlet pipe legs 210A-C. The separate portions of the HVAC system 100 refrigerant flowing through the evaporator coil 201 may recombine in the manifold 212 before exiting the evaporator section 200 via the common suction pipe 120.

In an embodiment, the evaporator section 200 may include the distributor sensor 214. The distributor sensor 214 may directly sense, calculate, approximate, or determine from sensed data, the HVAC system 100 refrigerant temperature within the portion of piping to which the distributor sensor 214 is coupled. The distributor sensor 214 may operably connect to the controller 102 via a wired or wireless connection and may transmit sensed data to the controller 102. In an embodiment, the distributor sensor 214 may be a thermistor. In an alternative embodiment, the distributor sensor 214 may be a thermocouple, resistive temperature device, infrared sensor, thermometer, or the like.

In an embodiment, the distributor sensor 214 may transmit analog or pneumatic signals either directly, or indirectly, to the controller 102. In such an embodiment, the signal transmitted by the distributor sensor 214 may be converted to a digital signal prior to use by the controller 102. Alternatively, in an embodiment, the distributor sensor 214 may transmit a digital signal to the controller 102. In such an embodiment, the digital signal transmitted by the distributor sensor 214 may be processed prior to use by the controller 102 to convert the signal to a different voltage, to remove interference, to amplify the signal, or other similar forms of digital signal processing. For each alternative described, herein, the signal of the distributor sensor 214 may be transmitted to the controller 102 directly or indirectly, such as through one or more intermediary devices.

According to the embodiment shown, the distributor sensor 214 may couple to the distributor tube 204A at a point near the end of the distributor tube 204A proximal to the inlet tube 206A of the evaporator coil 201. The distributor sensor 214 may sense temperature data for the HVAC system 100 refrigerant within the distributor tube 204A which may be a mixture of both liquid phase and gas phase refrigerant. The HVAC system 100 refrigerant within the distributor tube 204A may be substantially at the saturation temperature of the HVAC system 100 refrigerant. The saturation temperature may be the temperature at which the HVAC system 100 changes from a liquid to a gaseous state within the evaporator section 200 as part of the vapor compression cycle. The distributor sensor 214 may, therefore, sense refrigerant temperature data substantially at, or closely approximating, the saturation temperature of the HVAC system 100 refrigerant, meaning the temperature data sensed by the distributor sensor 214 may closely approximate, or be equal to, the saturation temperature. In an embodiment, for example, the distributor sensor 214 may couple to the distributor tube 204A and may sense HVAC system 100 refrigerant temperature data indicating an HVAC system 100 refrigerant temperature within 1 degree Fahrenheit of the saturation temperature.

The temperature of the HVAC system 100 refrigerant within the distributor tube 204A may be substantially the same as the temperature of the HVAC system 100 refrigerant within the distributor tubes 204B and 204C. Accordingly, in an embodiment, the distributor sensor 214 may be coupled to any from among the distributor tubes 204A-C while still having the features, functions, and characteristics as those of the embodiment described, herein.

The controller 102 may receive refrigerant temperature data from one or more of the sump sensors 109A, B and from the distributor sensor 214. In such an embodiment, the sump sensors 109A, B may sense refrigerant temperature data for the HVAC system 100 refrigerant substantially at the respective compressors 104A, B sumps, as described above. The refrigerant temperature at the sumps of the compressors 104A, B may indicate the condition of the lubricant-refrigerant mixture compositions within the compressors 104A, B. The distributor sensor 214 may sense temperature data for the HVAC system 100 refrigerant within the evaporator section 200 just prior to the HVAC system 100 refrigerant entering the evaporator coil 201. The HVAC system 100 refrigerant temperature data sensed by the distributor sensor 214 may closely approximate the saturation temperature of the HVAC system 100 refrigerant.

The refrigerant temperature data received by the controller 102 may be used to calculate, estimate, or determine one or more parameter values which may indicate whether unsafe operating conditions exist within the HVAC system 100. In an embodiment, for example, the controller 102 may use the received refrigerant temperature data from the sump sensors 109A, B and the distributor sensor 214 to calculate, or estimate, super heat temperature values for the HVAC system 100 refrigerant with the respective compressors 104A, B. The super heat temperature values may indicate the extent by which the temperatures of the HVAC system 100 refrigerant within the respective compressors 104A, B exceed the saturation temperature of the HVAC system 100 refrigerant.

The controller 102 may calculate, or estimate, a refrigerant super heat temperature value for each of the compressors 104A, B. The controller 102 may use refrigerant temperature data received from the sump sensor 109A and the distributor sensor 214 to calculate, or estimate, a refrigerant super heat temperature value for the compressor 104A. Similarly, the controller 102 may use refrigerant temperature data received from the sump sensor 109B and the distributor sensor 214 to calculate, or estimate, a refrigerant super heat temperature value for the compressor 104B. The controller may use the refrigerant super heat temperature values as part of one or more compressor protection and/or control methods. For example, the controller 102 may compare the respective super heat temperature values to a tolerance value, or values. In an embodiment, the controller 102 may be implemented with logic allowing for continued operation of the compressor, or compressors 104A and/or B only at times when the respective super heat temperature value corresponding to the energized compressor, or compressors, 104A and/or B is sufficiently high, such as above a predefined minimum tolerance value.

Operation of the compressors 104A, B only at times when the refrigerant super heat temperature values of the respective compressor 104A, B is sufficiently high may ensure the compressors 104A, B are not operated while unsafe conditions are present within the HVAC system 100. Further, operation of the respective compressors 104A, B at only while the respective refrigerant super heat temperature values are above the tolerance value may ensure that only gaseous refrigerant is present within the respective compressors 104A, B. The occurrence of dilution of oil within the compressors 104A, B, which may be caused by the presence of liquid refrigerant within the respective compressor 104A, B sumps may be reduced, or prevented.

The controller 102 may command one or more corrective actions, such as de-energizing one or both compressors 104A, B, in response to an out-of-tolerance condition to protect the compressor, or compressors, 104A, B from continued operation in unsafe conditions. Further, the controller 102 may energize one or more crank case heaters 110A, B in response to an out-of-tolerance condition. Additionally, the controller 102 may initiate an alert for communicating the out-of-tolerance condition to a user of the HVAC system 100.

Figure 3:
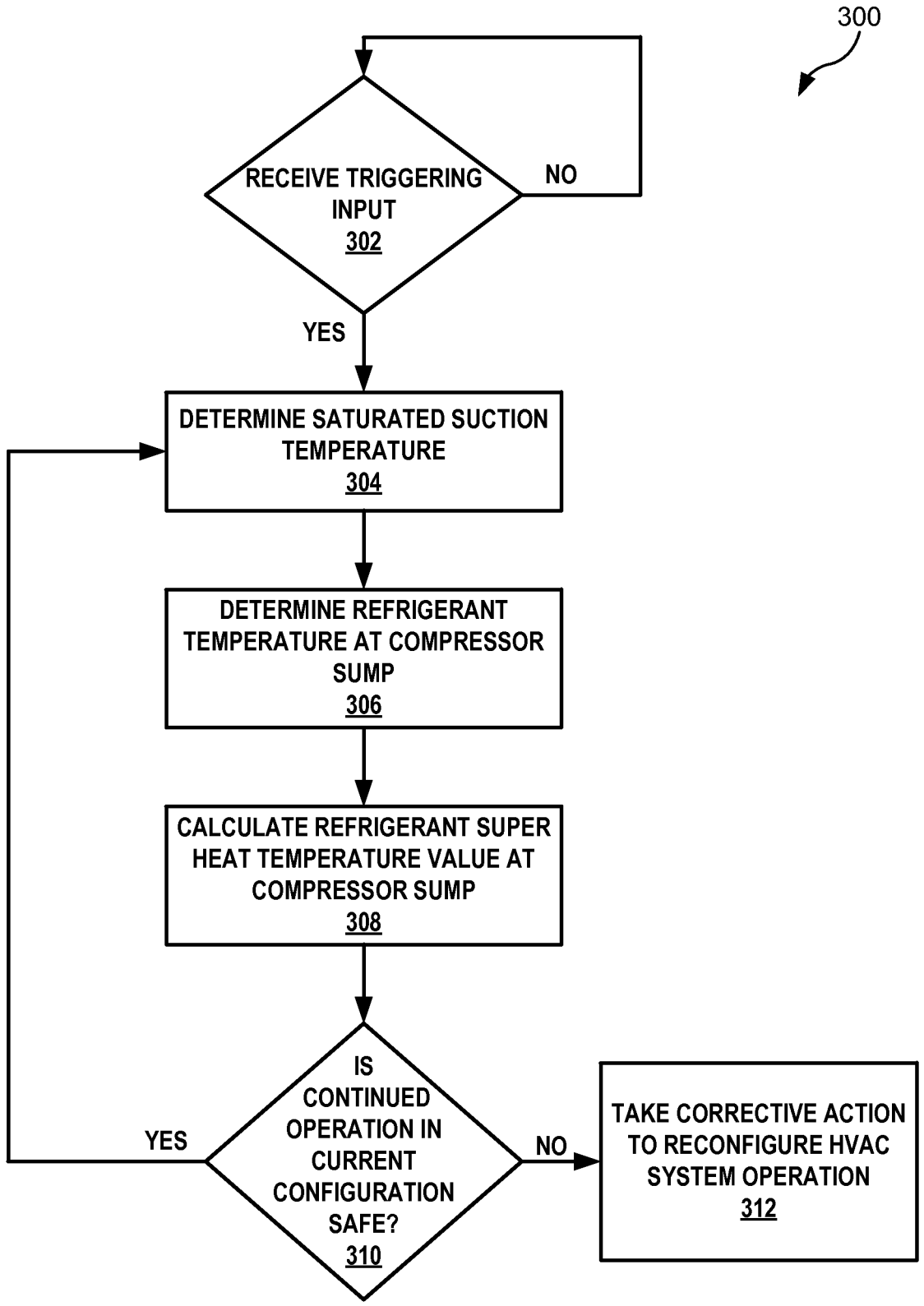

Turning, now, to FIG. 3, a flowchart of a method 300 for protection and control of a compressor 104 within an HVAC system 100 is shown. The method 300 may be utilized to protect and control each compressor 104 of the HVAC system 100, individually, regardless of the particular component configuration of the HVAC system 100. In an embodiment, fewer, additional, or different steps may be provided than those shown in FIG. 3. Additionally, in an embodiment, the steps of the method 300 may be performed in an order differing from that shown in FIG. 3.

In an embodiment, the method 300 may be performed by controller 102 of the HVAC system 100. The HVAC system 100 may have a component configuration according to any of the alternative embodiments described, herein and above. Specifically, although a tandem compressor configuration is shown in the HVAC system 100 embodiment of FIG. 1, the method 300 may be implemented in alternative embodiments of the HVAC system 100 provided with a single compressor component configuration. The method 300 may be executed independently of other monitoring, protection, and/or control methods executed by the controller 102. Alternatively, the method 300 may be executed by the controller 102 as part of one or more concurrently executed monitoring, protection, and/or control methods.

As part of execution of the method 300, one or more refrigerant super heat temperature values at the sump of one or more energized compressors 104 may be determined. In an embodiment, a separate refrigerant super heat temperature value for each energized compressor 104 may be determined simultaneously through execution of the method 300. Alternatively, in an embodiment, a single refrigerant super heat temperature value corresponding to only one energized compressor 104 may be determined through execution of the method 300. In such an alternative embodiment, the controller 102 may be configured initiate a separate execution of the method 300 for each compressor 104 energized.

In an embodiment, the controller 102 may calculate a refrigerant super heat temperature value for only the energized compressor, or compressors, 104 of the HVAC system 100. Alternatively, in an embodiment, the controller 102 may calculate a refrigerant super heat temperature value for each compressor 104 of the HVAC system 100, regardless of whether a particular compressor 104 is in the energized state or the de-energized state.

The controller 102 may reconfigure aspects of the HVAC system 100 operation in response to the one or more refrigerant super heat temperature values determined. According to the embodiment shown, for example, the method 300 may be used for monitoring, protecting, and/or controlling the compressors 104A, B. The controller 102 may execute the method 300 during operation of the HVAC system 100 to ensure that the compressors 104A and/or 104B are not energized, or operated, during times when unsafe conditions exist within the HVAC system 100, such as during times when liquid refrigerant may be present within one or more of the compressors 104A and/or 104B. Additionally, or alternatively, the one or more refrigerant super heat temperature values at the sump of one or more compressors 104 determined through execution of the method 300 may be used by the controller 102 as input for additional, concurrently executed protection and/or control methods.

In an embodiment, control of the crank case heaters 110A, B may be performed by the controller 102 as part of execution of the method 300. In an embodiment, for example, a refrigerant super heat temperature value determined during execution of the method 300 may be used by the controller 102 for monitoring and/or controlling the operation of the crank case heater 110 to protect the compressor 104. The refrigerant super heat temperature value at the sump of the compressor 104A, for example, may be an input determining when to selectively energize the crank case heater 110A to warm refrigerant within the compressor 104A. In such an embodiment, the crank case heater 110 corresponding to a specific compressor 104 may be energized by the controller 102 following a de-energizing of the specific compressor 104 in response to detection of an out-of-tolerance refrigerant super heat temperature value.

Referring to FIG. 3, at the step 302 the controller 102 may sense a triggering input initiating execution of the method 300. The triggering input may be a signal indicating a demand on the HVAC system requiring switching of a compressor 104 from the de-energized to energized state. The demand may require energizing of at least one compressor 104 following a period of non-operating time of the HVAC system 100, such as the onset of a partial load demand or a full load demand. The demand may, alternatively, require energizing of a previously de-energized compressor 104 following a period in which one or more other compressors 104 may have been energized, such as when a full load demand follows a period of partial load demand.

Additionally, or alternatively, the triggering input may be a signal commanding determination of one or more refrigerant super heat temperature values as part of repeated execution of the method 300 during operation of the HVAC system 100. Further, the triggering input may be a signal commanding determination of one or more refrigerant super heat temperature values as part of execution of one or more other methods for monitoring, protecting, and/or controlling the operation of the HVAC system 100 which may be executed by the controller 102. The signal commanding determination of one or more refrigerant super heat temperature values may be generated within the controller 102 as part of the control logic of the HVAC system 100. The control logic may comprise one or more methods stored within the controller 102. Alternatively, the controller may receive triggering input from a user of the HVAC system 100 or from an input signal received from a remote device, such as a thermostat within the conditioned space.

At the step 304, the controller 102 may determine the saturated suction temperature of refrigerant within the evaporator section 200 of the HVAC system 100. In an embodiment, the controller 102 may receive a signal from the distributor sensor 214 indicating one or more temperature values of the HVAC system 100 refrigerant within the distributor tube 204A substantially at the inlet to the evaporator coil 201. The HVAC refrigerant within the distributor tube 204A may comprise a mixture of both liquid and gaseous refrigerant. The refrigerant mixture may be at a temperature substantially equal to the saturated suction temperature at which the HVAC system 100 refrigerant boils within the evaporator coil 201.

In an embodiment, the controller 102 may set the saturated suction temperature value at the step 304 to be equal to the temperature value, or values, indicated by the signal received from the distributor sensor 214. Alternatively, in an embodiment, the controller 102 may calculate, or estimate, the saturated suction temperature value at the step 304 using the temperature value, or values, indicated by the signal received from the distributor sensor 214 along with one or more calibration equations that may be stored within the controller 102 memory. For example, the controller 102 may determine the saturated suction temperature to be the temperature value equal to the temperature value, or values, indicated by the signal received from the distributor sensor 214 minus one degree Fahrenheit, perhaps.

In an embodiment, the controller 102 may determine the saturation suction temperature of refrigerant within the evaporator section 200 immediately upon receiving temperature values from the distributor sensor 214 at the step 304. In alternative embodiments, at the step 304, the controller 102 may be configured to wait a period of time prior to determining the saturation suction temperature of the refrigerant within the evaporator section 200 of the HVAC system 100. The wait time may allow for the HVAC system 100 to reach steady state operation in instances in which the execution of the method 300 may have been preceded by the energizing, or de-energizing of at least one of the compressors 104. The wait time may be amount of time sufficient to ensure the saturation suction temperature determined at the step 304 is not determined during transient operation of the HVAC system 100. In an embodiment, for example, the controller 102 may wait for a period of time in the range of between thirty seconds and five minutes to elapse before determining the saturation suction temperature, allowing for the temperature of the refrigerant at the distributor tube 204A to normalize following energizing, or de-energizing, of the compressors 104A and/or 104B.

In a further alternative embodiment, the controller 102 may be configured to wait at the step 304 until the signals received from the distributor sensor 214 indicate the HVAC system 100 has ceased transient operation and/or has commenced steady state operation. In such embodiments, the controller 102 may be implemented with logic defining one or more tolerance values defining a maximum rate of temperature change for temperature values indicated by the signal received from the distributor sensor 214. The HVAC system 100 may be operating in transient mode at times when the tolerance value defining a maximum rate of temperature change is exceeded. The controller 102 may wait until the refrigerant temperatures indicated by the signal received from the distributor sensor 214 indicate a change rate that is below the tolerance value.

At the step 306, the controller 102 may determine the refrigerant temperature at the sump of at least one energized compressor 104. In an embodiment, the controller 102 may receive a signal from the sump sensor 109 corresponding to an energized compressor 104 and indicating temperature values of the HVAC system 100 refrigerant substantially at the sump of the energized compressor 104. The controller 102 may set the sump refrigerant temperature of the energized compressor 104 to equal to the value indicated by the corresponding sump sensor 109. Alternatively, in an embodiment, the controller 102 may calculate, or estimate, the respective sump refrigerant temperature value for the energized compressor 104 from the temperature values indicated by the corresponding sump sensor 109. In such an embodiment, temperature values indicated by the sump sensor 109 may be calibrated using one or more calibration equations which may be stored within the controller 102 memory.

At the step 308, the controller 102 may calculate a refrigerant super heat temperature value corresponding to an energized compressor 104. In an embodiment, the controller 102 may subtract the saturated suction temperature determined at the step 304 from the refrigerant temperature at the sump of at least one energized compressor 104 determined at the step 306. The resulting temperature value may be the refrigerant super heat temperature value of refrigerant at the sump of the energized compressor 104.

At the step 310, the controller 102 may determine whether continued operation of an energized compressor is safe. The controller 102 may compare a refrigerant super heat temperature value calculated at the step 308 to a tolerance value. The outcome of such a comparison may indicate whether continued operation of the energized compressor 104 is safe. In an embodiment, the tolerance value may indicate a minimum refrigerant super heat temperature value at which a compressor 104 may be operated.

If, at the step 310, the controller 102 determines that the calculated refrigerant super heat temperature value is above the tolerance value, the controller 102 may determine that continued operation of the energized compressor 104 is safe. If no unsafe conditions are detected, the controller 102 may exit the method 300. Alternatively, the controller 102 may return to the step 304, continuously executing the steps 304 through 310 of the method 300 until a demand on the HVAC system 100 requiring operation of the energized compressor 104 ceases or until an unsafe condition is detected at the step 310. In yet another alternative, the controller 102 may be configured to wait a predefined period of time following a finding of no unsafe conditions at the step 310 before returning to the step 304 of the method 300 while a demand on the HVAC system 100 is present.

If, at the step 310, the controller 102 determines that the refrigerant super heat temperature value calculated at the step 308 is below a tolerance value, indicating that continued operation of the energized compressor 104 is unsafe, the controller 102 may initiate one or more corrective actions at the step 312. In an embodiment, for example, the controller 102 may de-energize the energized compressor 104. Additionally, or alternatively, the controller 102 may generate an alert communicating to a user of the HVAC system 100 that an out-of-tolerance condition exists within the HVAC system 100.

In an embodiment, the controller 102 may take additional corrective actions at the step 312 to reconfigure operation of the HVAC system 100 following detection of an out-of-tolerance refrigerant super heat temperature value at the step 310. For example, the controller 102 may switch another compressor 104 of the HVAC system 100 to the energized state to continue meeting a demand on the HVAC system 100 following de-energizing of the compressor 104 corresponding to the out-of-tolerance condition. The controller 102 may, additionally, energize the crank case heater 110 corresponding to the de-energized compressor 104 to protect the de-energized compressor 104 from further damage which may be caused by refrigerant condensation within the de-energized compressor 104.

The controller 102 may maintain the compressor 104 de-energized at the step 312 in the de-energized state until a defined amount of time elapses. In an embodiment, the defined amount of time may be the remaining operating time of the HVAC system 100 in response to a current demand. Alternatively, the defined amount of time may be a predefined period of time which may be stored within the memory of the controller 102. The predefined period of time may be, for example, within the range of between two and twenty minutes. Alternatively, the controller 102 may maintain the compressor 104 de-energized at the step 312 in the de-energized state until input is received from a user of the HVAC system 100.

In an embodiment, following execution of the method 300, the controller 102 may return the HVAC system 100 to normal operation. Upon returning to normal operation, the controller 102 may commence, or resume, execution of one or more monitoring, protection, and/or control methods configuring the HVAC system 100 components in response to demands on the HVAC system 100 as well as in response operating conditions. The monitoring, protection, and/or control methods may use one or more refrigerant super heat temperature values calculated during execution of the method 300 as an input and may further configure operation of the HVAC system 100 in response to the calculated values. The controller 102 may, for example, selectively energize, or de-energize, one or more HVAC system 100 components in response to the calculated values in accordance with the one or more monitoring, protection, and/or control methods which may be implemented by the controller 102. In an embodiment, for example, a refrigerant super heat temperature value may be used as input to one or more control methods for determining whether one or more compressors 104 may be safely energized, or operated at a higher capacity, to meet a demand on the HVAC system 100. Additionally, or alternatively, in an embodiment, a refrigerant super heat temperature value, as determined via execution of the method 300, may be used as part of one or more control methods for determining when one or more crank case heaters 110 may be energized to warm the refrigerant within one or more of the compressors 104.

In a particular embodiment, an HVAC system 100 having a component configuration substantially the same as that shown in FIGS. 1 and 2, may include the compressors 104A, B configured for tandem operation. The sump sensors 109A, B, which may be thermistors, may be coupled to the side surface of the compressors 104A, B, respectively, and may sense the refrigerant temperature at the sumps of the compressors 104A, B, respectively. The condenser 106 may be a micro-channel heat exchanger. The evaporator coil 201 may be a micro-channel heat exchanger. The distributor sensor 214, which may be a thermistor, may be coupled to the distributor tube 204A of the evaporator coil 201. An HVAC system 100, according to the particular embodiment described, may implement the method 300, using the controller 102, as described below.

At the step 302, the controller 102 may receive a triggering input which may be the reception of a signal indicating a partial load demand on the HVAC system 100 requiring energizing of the compressor 104A. The controller 102 may wait, following energizing of the compressor 104A in response to the partial load demand sensed at the step 302, for two minutes to allow the HVAC system 100 to reach steady state operation.

At the expiration of the waiting period, the controller 102 may determine the saturated suction temperature for the HVAC system 100 refrigerant within the evaporator section 200. The controller 102 may receive a signal from the distributor sensor 214 indicating refrigerant temperature values for refrigerant entering the evaporator. The temperature value indicated by the signal received from the distributor sensor 214 may be calibrated by the controller 102 using a calibration equation stored within the controller 102 memory. The calibration equation may be derived from test data. The controller 102 may set the saturated suction temperature of refrigerant within the evaporator section 200 to be equal to the calibrated temperature value.

The controller 102 may determine the refrigerant temperature at the sump of the energized compressor, which may be the compressor 104A, at the step 306. The controller 102 may receive a signal from the sump sensor 109A indicating the temperature value of the HVAC system 100 refrigerant at the compressor 104A sump. The controller 102 may set the compressor 104A sump refrigerant temperature value to be equal to the refrigerant temperature value by the sump sensor 109A.

At the step 308, the controller 102 may calculate the refrigerant super heat temperature value of refrigerant at the compressor 104A sump. The controller 102 may subtract the saturated suction temperature from the compressor 104A sump temperature to determine the refrigerant super heat temperature value of refrigerant at the compressor 104A sump.

At the step 310, the controller 102 may compare the refrigerant super heat temperature value calculated at the step 308 to a tolerance value to determine whether continued operation of the compressor 104A is safe. The controller 102 may determine continued operation of the compressor 104A is unsafe based on a finding that the refrigerant super heat temperature value calculated at the step 308 is below a tolerance value defining the minimum refrigerant super heat temperature value at which a compressor 104 may be operated.

The controller 102 may respond to the finding that continued operation of the compressor 104A is unsafe by generating control signals for de-energizing the compressor 104A at the step 312. The controller 102 may, further, cause an alert communicating the unsafe condition to a user of the HVAC system 100. The controller 102 may also energize the compressor 104B at the step 312 to continue meeting the demand on the HVAC system 100 following de-energizing of the compressor 104A and may energize the crank case heater 110A to warm the idle refrigerant within the de-energized compressor 104A.

The controller 102 may continue to operate the HVAC system 100 in the configuration set at the step 312 to meet the demand on the HVAC system 100, continuously repeating execution of the method 300 to monitor, protect, and control the energized compressor 104B. The controller 102 may maintain the compressor 104A in the de-energized state until at least a predefined period of time elapses, which may be ten minutes.

In the previous discussion, numerous specific details are set forth to provide a thorough understanding of the present invention. However, those skilled in the art will appreciate that the present invention may be practiced without such specific details. In other instances, well-known elements have been illustrated in schematic or block diagram form in order not to obscure the present invention in unnecessary detail. Additionally, for the most part, details concerning well-known features and elements have been omitted inasmuch as such details are not considered necessary to obtain a complete understanding of the present invention, and are considered to be within the understanding of persons of ordinary skill in the relevant art.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of other features. Many such variations and modifications may be considered desirable by those skilled in the art based upon a review of the foregoing description of preferred embodiments.

The invention claimed is:

1. An HVAC system, comprising:

a first compressor comprising a first sump, the first compressor configured to be in fluid communication with a common suction pipe;

a first sensor coupled to the first compressor, the first sensor configured to transmit a first signal to a location remote to the first sensor, the first signal indicating at least one temperature value of refrigerant at the first sump;

an evaporator coupled to a first distributor tube of a plurality of distributor tubes at an inlet of the evaporator and in fluid communication with the common suction pipe at an outlet of the evaporator;

a second sensor coupled to the first distributor tube of the plurality of distributor tubes and positioned at a point near an end of the first distributor tube proximate to the inlet of the evaporator, the second sensor configured to transmit a second signal to a location remote to the second sensor, the second signal indicating at least one temperature value of refrigerant within the first distributor tube of the plurality of distributor tubes;

a controller operable to:

receive the second signal;

determine, after expiration of a period of time, an estimated saturated suction temperature based at least in part upon the at least one temperature value of refrigerant within the first distributor tube of the plurality of distributor tubes indicated by the second signal, wherein the period of time corresponds to a time for the first compressor to reach steady state operation;

receive the first signal;

determine a first super heat value based at least in part upon the estimated saturated suction temperature and the at least one temperature value of refrigerant at the first sump indicated by the first signal;

determine whether the first super heat value is less than a first tolerance value;

responsive to a determination that the first super heat value is less than the first tolerance value, generate a first control signal configured to switch the first compressor to a de-energized state from an energized state, wherein the determination is an indication that continued operation of the first compressor is unsafe.

2. The system of claim 1, wherein the first and second sensors are thermistors and the evaporator is a microchannel heat exchanger.

3. The system of claim 1, wherein the first super heat value is the difference between the at least one temperature value of refrigerant at the first sump and the estimated saturated suction temperature.

4. The system of claim 3, wherein the estimated saturation suction temperature is substantially equal to the at least one temperature value of refrigerant within the first distributor tube of the plurality of distributor tubes indicated by the second signal.

5. The system of claim 3, wherein the controller is further operable to:

determine the estimated saturated suction temperature based at least in part upon a first calibration equation, wherein an input to the first calibration equation comprises the at least one temperature value of refrigerant within the first distributor tube of the plurality of distributor tubes indicated by the second signal.

6. The system of claim 1, wherein the first sensor is coupled to an external surface of the first compressor at a location proximal to the location of the first sump, the first sump disposed internal to the first compressor.

7. The system of claim 6, further comprising:

a first crank case heater coupled to the first compressor, the first crank case heater comprising a first band extending around and in contact with the first compressor along one or more external surfaces of the first compressor; and wherein the first sensor is coupled to the first compressor by the first band of the first crank case heater.

8. The system of claim 1, wherein the controller is further operable to:

receive a triggering input signal; and determine, in response to receiving the triggering input signal, the estimated saturated suction temperature based at least in part upon the at least one temperature value indicated by the second signal.

9. The system of claim 8, wherein the triggering input signal indicates a demand on the HVAC system requiring switching of at least the first compressor to the energized state.

10. The system of claim 1, further comprising:

a second compressor comprising a second sump, the second compressor configured to be in fluid communication with the common suction pipe;

a third sensor coupled to the second compressor, the third sensor configured to transmit a third signal to a location remote to the third sensor, the third signal indicating at least one temperature value of refrigerant at the second sump;

wherein the controller is further operable to:

receive the third signal;

determine a second super heat value based at least in part upon the estimated saturated suction temperature and the at least one temperature value of refrigerant at the second sump indicated by the third signal; and generate a second control signal configured to switch the second compressor to a de-energized state from an energized state if the second super heat value is less than a second tolerance value.

11. An HVAC system, comprising:

a first compressor comprising a first sump, the first compressor configured to be in fluid communication with a common suction pipe;

a first sensor coupled to the first compressor, the first sensor configured to transmit a first signal to a location remote to the first sensor, the first signal indicating at least one temperature value of refrigerant at the first sump;

an evaporator coupled to a first distributor tube of a plurality of distributor tubes at an inlet of the evaporator and in fluid communication with the common suction pipe at an outlet of the evaporator;

a second sensor coupled to the first distributor tube of the plurality of distributor tubes and positioned at a point near an end of the first distributor tube of the plurality of distributor tubes proximate to the inlet of the evaporator, the second sensor configured to transmit a second signal to a location remote to the second sensor, the second signal indicating at least one temperature value of refrigerant within the first distributor tube of the plurality of distributor tubes;

a second compressor comprising a second sump, the second compressor configured to be in fluid communication with the common suction pipe;

a third sensor coupled to the second compressor, the third sensor configured to transmit a third signal to a location remote to the third sensor, the third signal indicating at least one temperature value of refrigerant at the second sump;

a controller operable to:

receive a triggering input signal indicating a demand on the HVAC system requiring switching of at least the first compressor to the energized state;

receive the second signal;

determine, after expiration of a period of time, an estimated saturated suction temperature based at least in part upon the at least one temperature value of refrigerant within the first distributor tube of the plurality of distributor tubes indicated by the second signal, wherein the period of time corresponds to a time for the first compressor to reach steady state operation;

receive the first signal;

determine a first super heat value, wherein the first super heat value is the difference between the at least one temperature value of refrigerant at the first sump indicated by the first signal and the estimated saturated suction temperature;

determine whether the first super heat value is less than a first tolerance value;

responsive to a determination that the first super heat value is less than the first tolerance value, generate a first control signal configured to switch the first compressor from an energized state to a de-energized, wherein the determination is an indication that continued operation of the first compressor is unsafe;

receive the third signal;

determine a second super heat value, wherein the second super heat value is the difference between the at least one temperature value of refrigerant at the second sump indicated by the third signal and the estimated saturated suction temperature;

determine whether the second super heat value is less than a second tolerance value;

responsive to a determination that the second super heat value is less than the second tolerance value, generate a second control signal configured to switch the second compressor from an energized state to a de-energized, wherein the determination is an indication that continued operation of the second compressor is unsafe.

12. A method for controlling a compressor of an HVAC system, comprising:

transmitting, using a first sensor coupled to a first compressor comprising a first sump, a first signal to a location remote to the first sensor, the first signal indicating at least one temperature value of refrigerant at the first sump, wherein the first compressor is in fluid communication with a common suction pipe;

transmitting, using a second sensor coupled to a first distributor tube of a plurality of distributor tubes, a second signal to a location remote to the second sensor, the second signal indicating at least one temperature value of refrigerant within the first distributor tube of the plurality of distributor tubes, wherein the first distributor tube of the plurality of distributor tubes is coupled to an inlet of an evaporator operatively coupled to be in fluid communication with the common suction pipe at an outlet of the evaporator, wherein the second sensor is positioned at a point near an end of the first distributor tube of the plurality of distributor tubes proximate to the inlet of the evaporator;

receiving, using a controller, the second signal from the second sensor indicating at least one temperature value of refrigerant within the first distributor tube of the plurality of distributor tubes;

determining after expiration of a period of time, using the controller, an estimated saturated suction temperature based on at least the at least one temperature value indicated by the second signal, wherein the period of time corresponds to a time for the first compressor to reach steady state operation;

receiving, using the controller, the first signal from the first sensor indicating at least one temperature value of refrigerant at the first sump;

determining, using the controller, a first super heat value based at least in part upon the estimated saturated suction temperature and the at least one temperature value indicated by the first signal;

determining, using the controller, whether the first super heat value is less than a first tolerance value;

responsive to a determination that the first super heat value is less than the first tolerance value, generating, using the controller, a first control signal configured to switch the first compressor to a de-energized state from an energized state, wherein the determination is an indication that continued operation of the first compressor is unsafe.

13. The method of claim 12, wherein the first and second sensors are thermistors and the evaporator is a microchannel heat exchanger.

14. The method of claim 12, wherein the first super heat value is the difference between the at least one temperature value of refrigerant at the first sump and the estimated saturated suction temperature.

15. The method of claim 12, wherein the estimated saturation suction temperature is the at least one temperature value of refrigerant within the first distributor tube of the plurality of distributor tubes indicated by the second signal.

16. The method of claim 12, further comprising:

determining, using the controller, the estimated saturated suction temperature at least in part based upon a first calibration equation, wherein an input to the first calibration equation comprises the at least one temperature value of refrigerant within the first distributor tube of the plurality of distributor tubes indicated by the second signal.

17. The method of claim 12, wherein the first sensor disposed at a location along the external surface of the first compressor proximal to the location of the first sump, the first sump disposed internal to the first compressor.

18. The method of claim 17, further comprising:

a first crank case heater comprising a first band, wherein the first crank case heater is coupled to the first compressor with the first band extending around and in contact with the first compressor along one or more external surfaces of the first compressor; and wherein the first sensor is coupled, using the first band of the first crank case heater, to the first compressor.

19. The method of claim 12, further comprising:

receiving, using the controller, a triggering input signal indicating a demand on the HVAC system requiring switching of at least the first compressor to the energized state; and determining, using the controller, in response to receiving the triggering input signal, at least the estimated saturated suction temperature based at least in part upon the at least one temperature value indicated by the second signal.

* * * * *